US005323648A

United States Patent [19]

Peltier et al.

[11] Patent Number: 5,323,648

[45] Date of Patent: Jun. 28, 1994

[54] FORMATION EVALUATION TOOL

[75] Inventors: Bertrand P. M. Peltier, Saint Etienne Cedex, France; Emmanuel Detournay, Minneapolis, Minn.; Anthony K. Booer, Huntingdon, England

[73] Assignee: Schlumberger Technology Corporation, Houston, Tex.

[21] Appl. No.: 25,704

[22] Filed: Mar. 3, 1993

[30] Foreign Application Priority Data

Jun. 3, 1992 [GB] United Kingdom ..... 9204902

[51] Int. Cl.[5] ..... F21B 47/00; G01N 33/24

[52] U.S. Cl. ..... 73/151; 73/78; 73/81; 73/151.5; 73/152; 436/28; 166/250

[58] Field of Search ..... 73/78, 81, 151.2, 151, 73/152; 166/250; 436/250

[56] References Cited

U.S. PATENT DOCUMENTS

| | | | |
|---|---|---|---|
| 2,408,012 | 9/1946 | Williams | 73/152 |
| 3,785,200 | 1/1974 | Handy | 73/151 |
| 3,798,966 | 3/1974 | Plonche | 73/151 |
| 3,872,717 | 3/1975 | Fox | 73/84 |
| 3,934,468 | 1/1976 | Brieger | 73/155 |
| 3,961,524 | 6/1976 | de la Cruz | 73/88 E |
| 4,149,409 | 4/1979 | Serata | 73/151 |
| 4,434,653 | 3/1984 | Montgomery | 73/151 |
| 4,507,957 | 4/1985 | Montgomery et al. | 73/151 |
| 4,535,843 | 8/1985 | Jageler | 73/151 |
| 4,627,276 | 12/1986 | Burgess et al. | 73/151 |
| 4,674,328 | 6/1987 | Ward et al. | 73/151 |
| 4,686,653 | 8/1987 | Staron et al. | 73/151 X |
| 4,697,650 | 10/1987 | Fontenot | 73/151 X |
| 4,806,153 | 2/1989 | Sakai et al. | 73/151 |
| 4,843,878 | 7/1989 | Purfurst et al. | 73/155 |
| 4,852,399 | 8/1989 | Falconer | 73/151.5 |
| 4,852,665 | 8/1989 | Peltier et al. | 73/151.5 X |
| 4,860,581 | 8/1989 | Zimmerman et al. | 73/155 |
| 4,888,740 | 12/1989 | Brie et al. | 73/151 X |
| 4,936,139 | 6/1990 | Zimmerman et al. | 73/155 |
| 4,976,143 | 12/1990 | Casso | 73/151.5 |
| 5,042,595 | 8/1991 | Ladanyi | 175/50 |
| 5,065,619 | 11/1991 | Myska | 166/250 X |
| 5,165,274 | 11/1992 | Thiercelin | 73/151 |
| 5,202,681 | 4/1993 | Dublin, Jr. et al. | 73/151 X |

FOREIGN PATENT DOCUMENTS

| | | |
|---|---|---|
| 0163426A1 | 12/1985 | European Pat. Off. . |
| 0350978A1 | 1/1990 | European Pat. Off. . |
| 0466255A2 | 1/1992 | European Pat. Off. . |
| 2188354A | 9/1987 | United Kingdom . |

*Primary Examiner*—James C. Housel
*Assistant Examiner*—Milton I. Cano
*Attorney, Agent, or Firm*—Wayne I. Kanak

[57] ABSTRACT

A tool for measuring the mechanical properties of a formation through which a borehole has been drilled, comprising a tool body capable of being lowered into a borehole, the tool body having pads mounted on movable arms, each pad carrying a PDC type cutter which is urged against wall of the borehole so as to cut into the formation; transducers are provided for determining the depth of cut made by the cutter and for determining the resistance of the rock to cutting. The tool is connected to a wireline, enabling the cutter to be moved through the formation and the data from the transducers to be returned to the surface for analysing the depth of cut and resistance to cutting to determine the mechanical properties of the rock.

12 Claims, 3 Drawing Sheets

FORMATION EVALUATION TOOL

BACKGROUND OF THE INVENTION

The present invention relates to a tool for measuring the mechanical properties of a ground formation, typically an underground formation traversed by a borehole such as a hydrocarbon well.

When drilling a well such as a hydrocarbon well, it is necessary to obtain information about the nature of the formation being drilled. While some information can be derived from the drilled material returned to the surface, it is often necessary that measurements be made in situ or on larger samples in order to obtain the necessary information. Certain properties can be measured by lowering a tool into the well and making non-intrusive measurements while the tool is moved vertically. This technique is known as electrical logging. The measurements made by the tool are returned to the surface as signals in a wire cable where they can be detected and analysed. Consequently, the technique is also known as wireline logging. Commonly measured properties relate to inherent properties of the formation such as electromagnetic, nuclear and sonic behaviour of the formation and allow the determination of formation resistivity, natural gamma-ray emission and sonic wave speed. However, wireline logging has not been particularly successful to date in determining mechanical properties of formations since this generally involves destructive testing of a sample. The approaches which have been used previously are either the immobilisation of a tool within the wellbore to allow in situ testing or side-coring to retrieve a sample of rock which is returned to the surface for laboratory testing. This latter approach is expensive and time consuming and neither technique allows a continuous logging approach in which measurements are made continuously as the tool is moved through the borehole.

It is an object of the present invention to provide a tool which can provide mechanical properties of the formations traversed by a borehole in a continuous logging operation.

SUMMARY OF THE INVENTION

In accordance with the present invention, there is provided a tool for measuring the mechanical properties of a formation through which a borehole has been drilled, comprising a tool body capable of being lowered into a borehole, the tool body having mounted thereon a cutter which is urged against wall of the borehole so as to cut into the formation; means for determining the depth of cut made by the cutter and for determining the resistance of the rock to cutting; and means for enabling the cutter to be moved through the formation and for analysing the depth of cut and resistance to cutting to determine the mechanical properties of the rock.

Preferably the cutter comprises a polycrystalline diamond compact (PDC) cutter such as are used in drag-type drill bits. The cutter can be mounted on a pad which is connected to the main part of the tool body by resiliently biassed arms which urge the pads and cutter against the borehole wall.

In use the tool is lowered into a borehole and measurements are taken as the tool is withdrawn from the borehole. Transducers can be provided to measure the depth of cut made by the cutter and the resistance to the movement of the cutter through the formation.

The measurements made by the transducers can be analysed in a manner similar to that described in our co-pending European Patent Application Number 91201708.4 which is incorporated herein by reference. The output from the tool can be used to compute the internal friction angle $\Phi$ of the rock and other such mechanical properties.

The cutter action can be described by the equation $$\frac{F_S}{\delta} = \omega E_0 + \mu \frac{F_n}{\delta} \quad (1)$$

where $\delta$ is the depth of cut $\omega$ is the width of the cutter $\mu = \text{Tan}(\Phi) =$ internal friction angle of the rock $E_0$ is a regression parameter.

The data from the transducers provides values of $F_S$ $F_n$ and $\delta$ and a simple linear regression is used to obtain $\mu$ and hence $\Phi$. Alternatively a state space model can be used to yield a continuous evaluation of F. without the need for any cross plot.

BRIEF DESCRIPTION OF THE DRAWINGS

The present invention will now be described by way of example, with reference to the accompanying drawings in which.

DESCRIPTION OF THE PREFERRED EMBODIMENT

Figure 1:
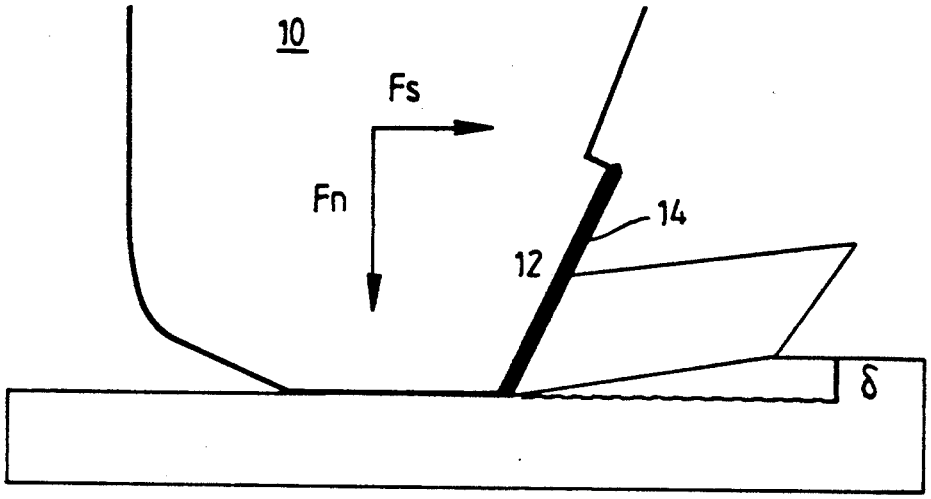
FIG. 1 shows a schematic view of a PDC type cutter.

The action of a drag cutter such as a PDC cutter is illustrated in FIG. 1 and described in our co-pending application referenced above. The cutter is mounted on a tool as described in relation to FIG. 2 and comprises a stud 10 having a flat cutting face 12 on which a layer of hard abrasive material 14 is deposited. In the case of a PDC cutter, the material 14 is a synthetic polycrystalline diamond bonded during synthesis onto a tungsten carbide/cobalt metal support 12.

Figure 2:
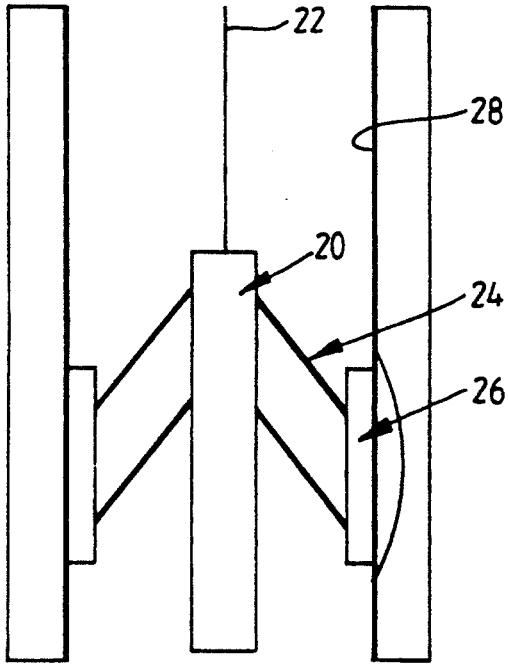
FIG. 2 shows a general diagram of a logging tool in accordance with one embodiment of the invention.
Figure 3:
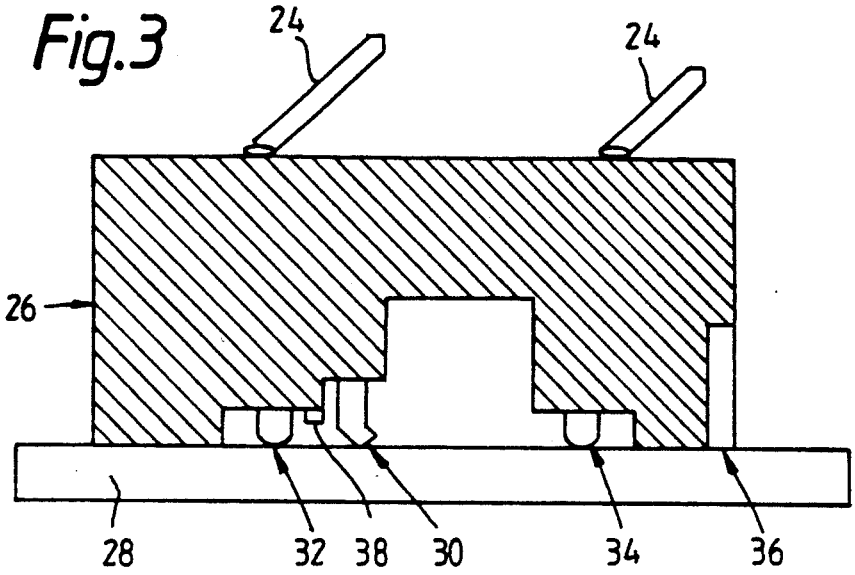
FIG. 3 shows a more detailed diagram of part of the tool shown in FIG. 2.

The tool shown in FIG. 2 corresponds in part to tools commonly used to measure electrical properties of formation and comprises a central main tool body 20 which can be lowered into the borehole by means of a wireline 22 which supplies power to the tool and enables data to be returned to the surface. The tool is provided with arms 24 on which are mounted sensor pads 26. The arms 24 can be operated to move the pads 26 away from the tool body 20 and urge them against the wall 28 of the borehole such that measurements can be made. In the case of measuring electrical properties, the pads 26 carry electrodes which contact the borehole wall. However, in the present case, each pad 26 carries a cutter and transducer arrangement as shown in FIG. 3. The cutter 30 is mounted on the pad 26 such that when the pad 26 is urged against the borehole wall 28 and the tool is pulled up by the wireline 22, the cutter 30 is constrained to cut a groove of a depth within certain limits, in this case typically 0.5–3 mm. A pair of displacement transducers 32, 34 is mounted one either side of the cutter 30 so as to monitor the exact depth of cut at any instant. Transducers (not shown) are also provided to measure the forces imposed on the cutter 30 normal to the direction of displacement ($F_n$) and parallel to the direction of displacement ($F_S$). The data from the transducers are sampled and analysed to extract the rock properties. The pad 26 also has a scraper 36 mounted on its leading edge contacting the borehole wall 28 which serves to scrape the surface smooth of any debris, mudcake etc. in order that the cutter 30 should only encounter the resistance of the formation when cutting.

In an alternative form of tool to that shown in FIG. 3, a pair of cutters is provided. A first cutter is fixed and serves to scrape the rock smooth as the tool is moved through the borehole. The second cutter is immediately behind the first cutter and is forced to cut a groove of fixed or variable depth into the smoothed rock. The second cutter is instrumented to measure the depth of cut by measuring displacement relative to the fixed first cutter. This can be achieved using a single LVDT transducer rather than the two transducers required in the previous arrangement. Again the cutter is instrumented to measure $F_n$ and $F_S$ as before. Since in this case, the means for measuring the depth of cut does not need to contact the rock there is no possibility that the transducers will deform or gouge the rock themselves and so give an inaccurate reading. Furthermore, both cutters should wear at approximately the same rate and so errors due to cutter wear are likely to be negligible.

In use, a typical drill bit-type PDC cutter is used. In drill bit applications, the cutters are typically run in the following conditions:

depth of cut = 1 mm
linear speed of cutter = 2 m/s
distance cut = 200 m/vertical meter drilled, i.e. 20,000 m cut from 100 m drill bit run.

In the logging application described above, the conditions would be:

depth of cut = 1 mm
linear speed of cutter = 0.3 m/s
distance cut = 1000 m.

The logging conditions are far less severe than drilling and so no substantial wear problems should be encountered.

The upper range for $F_S$, which determines the overpull on the wireline cable, is of the order of $F_S = 2$ kN for a $\omega = 10$ mm cutter (values of $\omega$ down to 5 mm are suitable). In order to avoid large fluctuations of overpull on the wireline cable with change of lithology, it is best to control the depth of cut $\delta$ through a servo-control mechanism to maintain $F_S$ within optimal limits. However, some variation in the measured channels is beneficial to the accuracy of the interpretation (linear regression) and could, when needed, be introduced by imposing small amplitude fluctuations on the value of $\delta$. The logging speed, insofar as it is not nil, need not be known to perform the interpretation.

Figure 4:
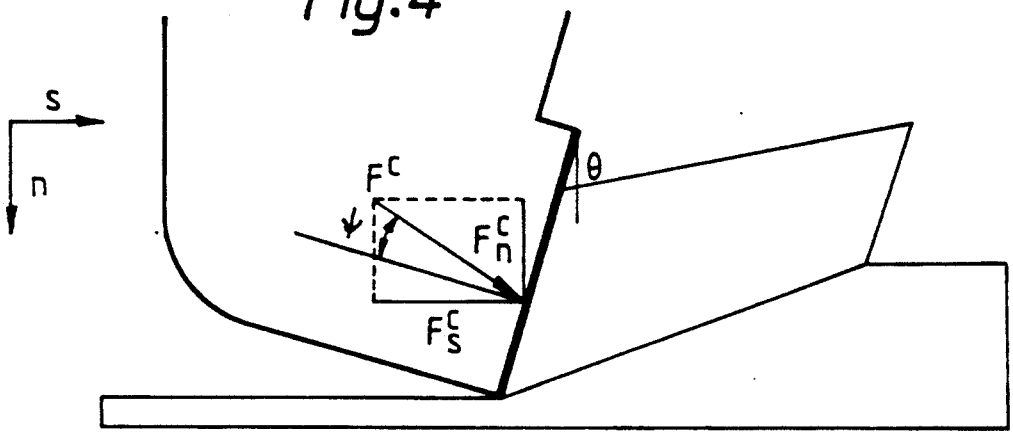
FIG. 4 shows the cutting action of a sharp PDC cutter.

The procedure for analysing the data obtained from the tool is given below. A perfectly sharp cutter tracing a groove of constant cross-sectional area A ($A = \delta\omega$) on a horizontal rock surface is shown in FIG. 4. The cutter has a vertical axis of symmetry by the backrake angle $\theta$ (contrary to the sign convention in metal cutting, $\theta$ is taken positive when the cutter is inclined forward). It is assumed that the cutter is under pure kinematic control, ie the cutter is imposed to move at a prescribed horizontal velocity with a zero vertical velocity (constant depth of cut). During the cutting, a force $\vec{F}^c$ is imparted by the cutter onto the rock; $F^c_s$ and $F_{cn}$ denoting the force components that are respectively parallel and normal to the rock surface.

It is assumed that the horizontal and vertical forces on the cutter, averaged over a distance large with respect to the depth of cut, are proportional to the cross-sectional area A of the cut:

$$F^c_s = \epsilon A \tag{1}$$

$$F^c_n = \xi \epsilon A \tag{2}$$

where the constant $\epsilon$ is defined as the intrinsic specific energy and $\xi$ is the ratio of the vertical to the horizontal force acting on the cutting face. The specific energy $\epsilon$ quantifies a complex process of rock destruction and generally depends on various factor, such as rock surface, etc. The term "intrinsic specific energy" $\epsilon$ represents the amount of energy spent to cut a unit volume of rock by a pure cutting action. The quantity $\epsilon$ has the same dimensions as a stress and that a convenient unit for $\epsilon$ is MPa (an equivalent unit for $\epsilon$ is the $J/cm^3$ which is numerically identical to the MPa).

A convenient ratio, $\xi$, between the vertical and the horizontal force implies that there is friction at the rock-cutter interface. Since a symmetric cut has been assumed here, no horizontal force orthogonal to the direction of the cut is expected. This is an ideal case, however, for which the vertical to horizontal force ratio, $\xi$, takes the particular maximum value $\xi^*$ $$\xi^* = \tan(\theta + \psi) \tag{3}$$

where $\psi$ denotes the interfacial friction angle.

Any argument about the direction of the cutting force $\vec{F}^c$ actually requires consideration of the kinematics of failed rock. Indeed, the projection of the force on the cutting face is taken to be parallel to $[\nu]$, the velocity of the failed rock relative to the cutter (principle of coaxiality). If the cross-sectional shape of the cut is symmetric (as it is usually enforced in a single cutter test) then the velocity discontinuity vector $[\nu]$, is parallel to the plane defined by the axis of symmetry and the cut direction. If symmetry is broken, as in the case of a cutter moving on an inclined surface, there is a relaxation of the constraint on the direction of $[\nu]$ leading generally to the existence of a transverse horizontal component of the cutting force.

Figure 5:
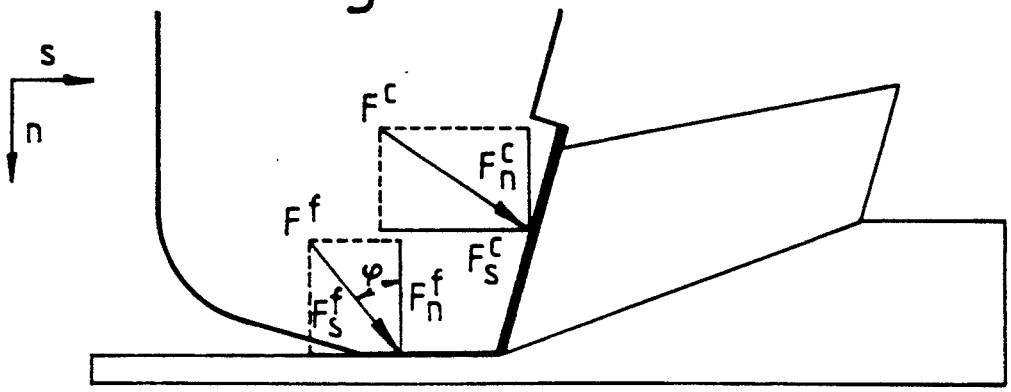
FIG. 5 shows the cutting action of a PDC cutter with a wear flat.

In the case of cutter with a wear flat, see FIG. 5, the cutter force $\vec{F}$ is now decomposed into two vectorial components, $\vec{F}^c$ transmitted by the cutting face, and $\vec{F}^f$ acting across the wear flat. It is assumed that the cutting component $F^c_n$ and $F^c_s$ obey the relations (1) and (2) postulated for the perfectly sharp cutter. It is further assumed that a frictional process is taking place at the interface between the wearflat and the rock; thus the components $F^f_n$ and $F^f_s$ are related by $$F^f_s = \mu F^f_n \tag{4}$$

where $\mu$ is a coefficient of friction.

On the basis of the fundamental equations (1), (2) and (4), a linear relation can be derived between the horizontal force components $F_S=F^c_s+F^f_s$, and the vertical force component $F_n=F^c_n+F^f_n$. Indeed, using (1) and (4), the horizontal component $F_S$ can be expressed as $$F_S=\epsilon A=\mu F^f_n \quad (5).$$

Writing $F^f_n$ as $F_n-F^c_n$ and using (2), this equation becomes $$F_S=(1-\mu\xi)\epsilon A=\mu F_n \quad (6).$$

Two quantities are now introduced: the specific energy defined as $$\epsilon=\frac{F_S}{A} \quad (7)$$

and the drilling strength S $$S=\frac{F_n}{A} \quad (8)$$

Both quantities and $\epsilon$ have the same general meaning but represents the energy spent by unit volume of rock cut, irrespective of the fact that the cutter is sharp or blunt, whereas $\epsilon$ is meaningful only for the cutting action.

For a perfectly sharp cutter, we have in view of the basic expression (1) and (2) and the definitions (7) and (8) that $$=\epsilon \text{ and } S=\xi\epsilon \quad (9).$$

For a blunt cutter, the following linear relationship exist between and S, which is simply obtained by dividing both member of (6) by A:

$$= {}_0+\mu S \quad (10)$$

where the quantity $_0$ is defined as $$_0=(1=\mu\xi)\epsilon \quad (11).$$

Equation (10) actually represents a constraint on the cutting response of a PDC cutter; in other words, the specific energy and the drilling strength S are not independent of each other, but are constrained by (10) when cutting and frictional processes are taking place simultaneously. The cutting "point" defined by (9) obviously satisfies the linear relation (10) and therefore only states that are characterised by $\geqq\epsilon$ (or alternatively by $S\geqq\xi\epsilon$) are physically admissible.

A series of single cutter tests verify this procedure. These tests are performed at atmospheric pressure with a milling machine, using PDC cutter having experienced various amount of wear. The cuts are made in the top surface of a sample of Berea sandstone by moving the cutter at a constant velocity of 5.6 cm/s parallel to the rock surface (and thus imposing a constant depth of cut). The length of the cuts range from 30 to 45 cm, and the depths of cut from 0.25 to 2.5 mm. Eight different cutters (labelled A, B, C, D, E, G, I, J, K) having a backrake of 20° and a diameter of either 12.7 mm or 19.1 mm are used. Two of these cutters (J and K) are "sharp", the others having a measurable wear flat ranging from 10.3 $mm^2$ for cutter A to 25.8 $mm^2$ for cutter I.

Table 1 summarises the relevant characteristics of the cutters used in these tests.

TABLE 1

| Cutter | Diameter (mm) | Wearflat area ($mm^2$) |
|---|---|---|
| A | 12.7 | 10.3 |
| B | 12.7 | 11.0 |
| C | 12.7 | 11.0 |
| E | 12.7 | 14.2 |
| G | 19.1 | 20.6 |
| I | 12.7 | 25.8 |
| J | 12.7 | 0. |
| K | 19.1 | 0. |

The results of the experiments on Berea Sandstone can be plotted in an -S diagram (not shown), with each point representing the average measurement for a particular experiment. When plotted, the points appear to define a friction line characterised by $\mu\simeq0.82$ and $_0\simeq14$ MPa. The cutting states for the two sharp cutters (J and K) are clustered near the lower left of the data cluster. The lower-left data point is taken as the best estimate of the cutting point; it is estimated here to be characterised by $\epsilon\simeq32$ MPa and $\xi\simeq0.8$. This value of $\xi$ implies that the interface friction angle $\psi\simeq19°$.

Figure 6:
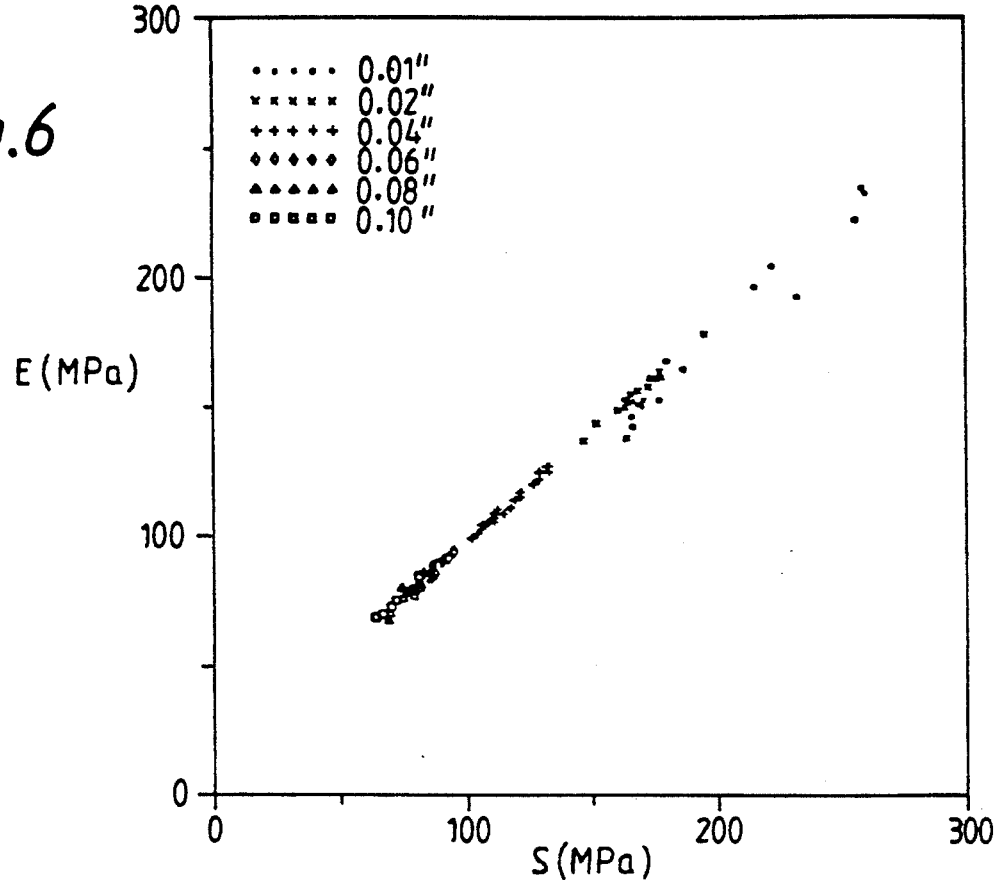
FIG. 6 shows the $\xi$-S diagram for a single cutter with a wear flat in Berea sandstone.
Figure 7:
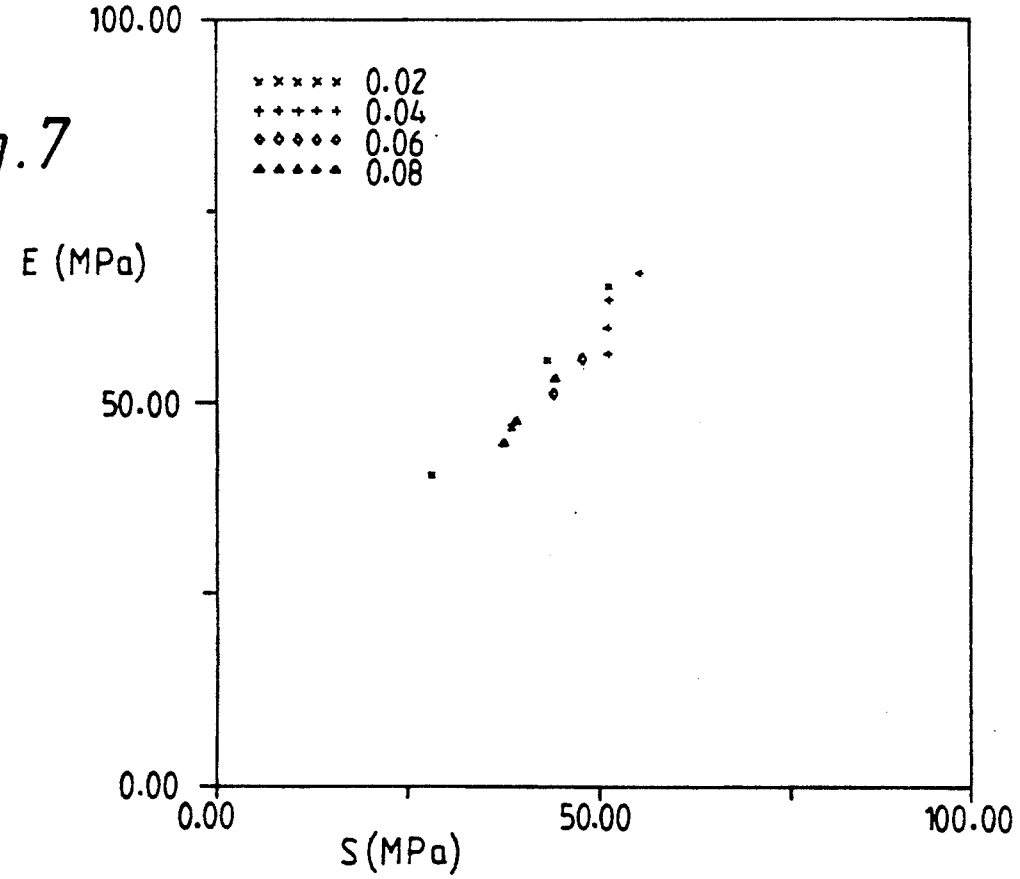
FIG. 7 shows the $\xi$-S diagram for a single sharp cutter in Berea sandstone.

The most comprehensive series of tests on the Berea sandstone are performed with cutter 1; 89 measurements being available. The corresponding data points in the diagram -S are plotted in FIG. 6 where the symbols are now used to differentiate between the different depths of cut. FIG. 7 shows a similar diagram for the experimental results obtained with one of the sharp cutters (cutter J).

A further embodiment of the invention includes an optical sensor immediately behind the cutters shown as 38 in FIG. 3 which can provide optical information about the formation from the cleaned surface. This may be achieved using a fiber optic device or the like.

We claim:

1. A tool for measuring mechanical properties of a formation through which a borehole has been drilled, comprising a tool body capable of being lowered into a borehole, the tool body having mounted thereon a cutter which is urged against wall of the borehole so as to cut into the formation; means for determining depth of cut made by the cutter and for determining the resistance of the formation to cutting; and means for enabling the cutter to be moved through the formation and means for providing data output for analysing the depth of cut and resistance to cutting to determine the mechanical properties of the rock.

2. A tool as claimed in claim 1, wherein the means for enabling the cutter to be moved through the formation comprise means for moving the tool body and the cutter axially through the borehole.

3. A tool as claimed in claim 2, wherein the means comprise a wireline cable system operated from ground level.

4. A tool as claimed in claim 1, wherein the cutter cuts an elongate groove in the formation.

5. A tool as claimed in claim 1, wherein the cutter comprises a polycrystalline diamond compact cutter.

6. A tool as claimed in claim 1, wherein the means for analysing the resistance to cutting of the formation as the tool is moved through the borehole comprises transducers for measuring the forces exerted on the cutter in directions normal and parallel to the direction of movement.

7. A tool as claimed in claim 1, wherein the cutter is mounted on a pad which is connected to a main part of the tool body by resiliently biassed arms which urge the pad and cutter against the borehole wall.

8. A tool as claimed in claim 1, wherein the means for determining the depth of cut comprises a displacement transducer connected to the cutter.

9. A tool as claimed in claim 7, wherein the pad which is configured to constrain the cutter to a depth of cut within predetermined limits.

10. A tool as claimed in claim 8, wherein a pair of displacement transducers are provided, one either side of the cutter.

11. A tool as claimed in claim 1, wherein a pair of cutters is provided, the first cutter being positioned on the tool to cut a groove in the formation so as to produce a substantially clean and even surface, and a second cutter being mounted behind the first and provided with means to monitor resistance to cutting and depth of cut relative to the first cutter.

12. A tool as claimed in claim 1, wherein an optical sensor is mounted on the tool so as to monitor the substantially clean surface of the groove behind a cutter.

* * * * *